US008877111B2

(12) United States Patent
Kasper

(10) Patent No.: US 8,877,111 B2
(45) Date of Patent: Nov. 4, 2014

(54) METHOD FOR PRODUCING A METAL LID WITH GUIDE POSTS FOR A CONTAINER

(75) Inventor: Wolfgang Kasper, Bonn (DE)

(73) Assignee: Ball Packaging Europe GmbH, Ratingen (DE)

( * ) Notice: Subject to any disclaimer, the term of this patent is extended or adjusted under 35 U.S.C. 154(b) by 172 days.

(21) Appl. No.: 13/325,324

(22) Filed: Dec. 14, 2011

(65) Prior Publication Data

US 2012/0103984 A1 May 3, 2012

Related U.S. Application Data

(62) Division of application No. 11/915,078, filed on Apr. 7, 2008.

(30) Foreign Application Priority Data

May 25, 2005 (EP) ..... 05104502
May 22, 2006 (WO) ..... PCT/EP2006/062507

(51) Int. Cl.
*B29C 45/14* (2006.01)
*B65D 17/00* (2006.01)

(52) U.S. Cl.
CPC ..... *B65D 17/165* (2013.01); *B65D 17/166* (2013.01); *B65D 2517/004* (2013.01)
USPC ..... 264/268; 264/279

(58) Field of Classification Search
CPC ..... B65D 17/165; B65D 17/166; B65D 2517/004
USPC ..... 264/268, 279, 328.1
See application file for complete search history.

(56) References Cited

U.S. PATENT DOCUMENTS

| | | | | |
|---|---|---|---|---|
| 2,822,952 | A | 2/1958 | Scott | |
| 3,070,257 | A | 12/1962 | Bojanowski | |
| 3,080,088 | A | 3/1963 | Corrinet | |
| 3,106,311 | A | 10/1963 | Fairchild | |
| 3,184,096 | A * | 5/1965 | Cheeley | 220/260 |
| 3,251,509 | A * | 5/1966 | Foster | 222/153.07 |

(Continued)

FOREIGN PATENT DOCUMENTS

| | | |
|---|---|---|
| CH | 494165 | 7/1970 |
| DE | 1934945 | 3/1966 |

(Continued)

OTHER PUBLICATIONS

Official Action for U.S. Appl. No. 11/915,078, mailed May 10, 2012 14 pages.

(Continued)

*Primary Examiner* — Jill Heitbrink
(74) *Attorney, Agent, or Firm* — Sheridan Ross P.C.

(57) ABSTRACT

The invention describes a lid for a container comprising an edge region (2) for sealing and permanent connection to a container body comprising a body portion and a bottom, and a substantially flat central region as a panel or lid surface (3), on which at least one projecting pin-like or post-like guide element (7', 7", 8) is formed extending from the panel (3) towards one side or the other substantially parallel to an axis (9) perpendicular to the lid surface. The posts can guide additional elements which are intended to form a functional unit with the lid.

16 Claims, 2 Drawing Sheets

(56) References Cited

U.S. PATENT DOCUMENTS

| | | | | |
|---|---|---|---|---|
| 3,439,831 | A | 4/1969 | Pullen | |
| 4,109,820 | A | 8/1978 | Stifano | |
| 4,207,991 | A | 6/1980 | Amabili | |
| 4,741,450 | A | 5/1988 | Braude | |
| 4,890,756 | A | 1/1990 | Waltke | |
| RE33,217 | E | 5/1990 | Nguyen | |
| 5,054,642 | A * | 10/1991 | Yoshida | 220/276 |
| 5,555,992 | A | 9/1996 | Sedgeley | |
| 5,785,201 | A | 7/1998 | Bordner et al. | |
| 6,050,440 | A | 4/2000 | McEldowney | |
| 6,158,608 | A | 12/2000 | Schlattl | |
| 6,935,826 | B2 | 8/2005 | Brifcani et al. | |
| 7,500,577 | B2 | 3/2009 | Wichelhaus | |
| 2004/0035871 | A1 | 2/2004 | Chupak | |
| 2004/0188440 | A1 | 9/2004 | Schlattl et al. | |
| 2008/0190934 | A1 | 8/2008 | Kasper | |

FOREIGN PATENT DOCUMENTS

| | | |
|---|---|---|
| DE | 20206956 | 4/2002 |
| DE | 20219794 | 4/2003 |
| DE | 202004000080 | 4/2004 |
| EP | 0283534 | 9/1988 |
| EP | 1361164 | 11/2003 |
| GB | 518778 | 3/1940 |
| WO | WO 02/28738 | 4/2002 |
| WO | WO 03/089167 | 10/2003 |
| WO | WO 2011/053776 | 5/2011 |

OTHER PUBLICATIONS

Final Action for U.S. Appl. No. 11/915,078, mailed Feb. 1, 2013 17 pages.

International Search Report prepared by the European Patent Office on Mar. 21, 2007 for PCT/EP2006/062507; Applicant, Ball Packaging Europe GmbH, 6 pages.

Written Opinion (including translation) for International (PCT) Patent Application No. PCT/EP2006/062507, dated Nov. 25, 2007, 12 pages.

International Preliminary Report on Patentability (including translation) for International (PCT) Patent Application No. PCT/EP2006/062507, dated Dec. 6, 2007, 14 pages.

Official Action for U.S. Appl. No. 11/915,078, mailed on Jun. 22, 2011.

Official Action (no translation available) for Taiwan Patent Application No. 095118411 mailed Feb. 13, 2012, 4 pages.

Official Action for U.S. Appl. No. 11/915,078, mailed Aug. 21, 2013 19 pages.

* cited by examiner

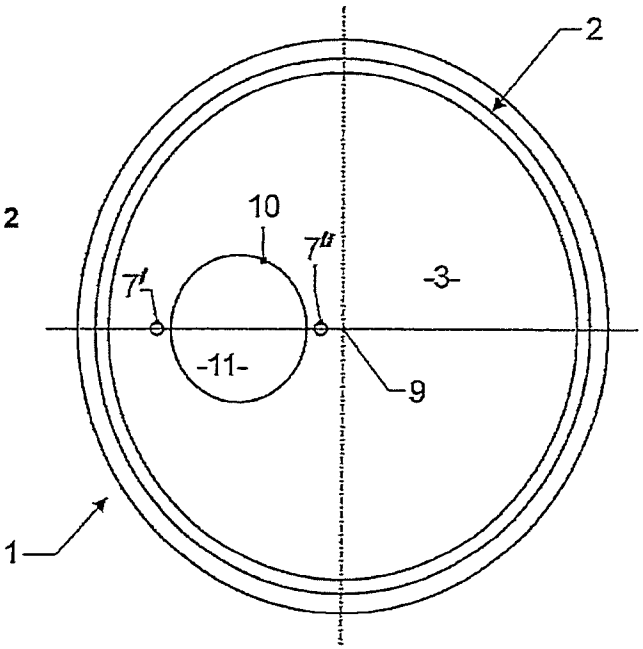
FIG. 2
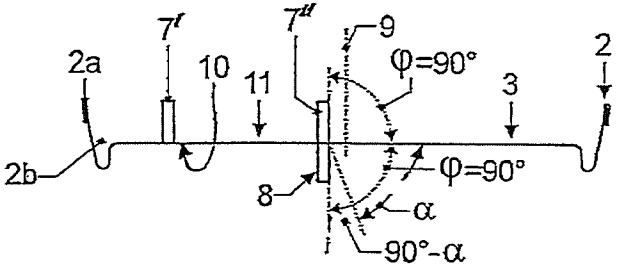
FIG. 3
FIG. 1
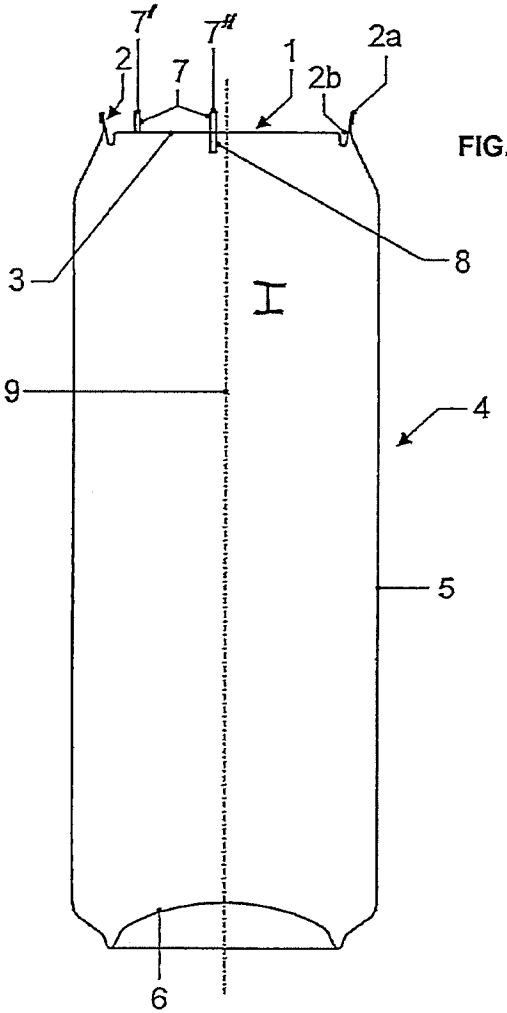

15
17
19''
19''
18''
-16-
18'
19'
20
19'
17
20a
-16-
18a
15
31
32
"b"
9
"a"
φ
30
33
"c"
43b'
43
43c
40
43a
42
41
42
43b''
43c

METHOD FOR PRODUCING A METAL LID WITH GUIDE POSTS FOR A CONTAINER

This application is a divisional of co-pending U.S. patent application Ser. No. 11/915,078, filed Apr. 7, 2008, the entire disclosure of which is incorporated herein by reference.

SUMMARY

The invention concerns a lid for containers comprising an edge region for—preferably sealing and permanent—connection to a container body comprising a body wall and a bottom. There are such containers for many different purposes, for example for filling with foodstuffs or beverages. The lids which serve for closure purposes can for that purpose have tear-open regions provided with a gripping tab (tab), for non-reversibly opening an outlet opening, as is known in particular from drinks cans. The invention therefore also preferably relates to sheet metal lids for closing beverage can bodies.

The object of the invention is to further develop a lid for a container body, such that in manufacture of the lid means are provided thereon which make it possible to fit one or more additional elements to the lid in such a way that they can be linearly moved relative to the lid in a direction in a given relationship with the axis of the lid. Those additional elements themselves are not subject-matter of the invention. Just by way of example mention will be made of an element for securely re-closing an open opening in the lid.

That object is attained in accordance with the claims. From the point of view of its manufacture the lid according to the invention has at least one or more guide elements in the substantially flat region (as a central planar region, panel or lid surface) which is surrounded by the edge region which serves for connection to the container body. The guide elements are in the form of pin-like or post-like guide elements and oriented substantially with their axis approximately parallel to the axis of the lid, which extends perpendicularly with respect to the lid surface.

As emphasized hereinbefore, a corresponding device can be reliably guidedly moved on that guide element or those guide elements, as a sealing closure element, linearly relative to the lid surface and approximately in the direction of the axis (lid axis).

In that respect a guide element as a protruding element is of such a height and configuration that it is suitable for guidance purposes, that is to say it allows a stroke movement or a displacement directed away from the surface region, in the heightwise direction. There are no pre-stamped rivets out of the lid sheet metal or projections on which for example an SOT tab is permanently and possibly rotatably fitted. Those fitting rivets do not have any guide property and also are not of such a geometrical configuration.

In the case of a lid with an opening delimited by an edge thereof, the at least one guide element is arranged outside the opening.

Depending on the respective purpose of use the guide elements can extend from the top side of the lid and/or from the bottom side of the lid, preferably inwardly relative to the interior of the container body.

Further advantageous configurations of the novel lid are set forth in the appendant claims.

The edge region (or also edge) extends around the central surface region. It is suitable for being fixed to the container body by a folded seam connection or bead connection. That body can be made in one piece, that is to say with a bottom, produced directly without a fold seam, on the body wall, which is often also referred to as the 'body'. The body itself however is not subject-matter of the lid in accordance with the independent claims. The sealing and permanent connection is afforded by the folded seam which is produced in an operation of flanging or folding the edge region of the lid on to the rim of the container body which matches it in associated relationship, that is to say the upper end of the body as the body edge. The two edges are matched to each other in such a way that the folded seam provides the sealed and permanent connection of the lid for closing the container body.

A closure function and an opening function, which then possibly take place, by way of re-closure of an additional element, can be effected in such a way as to be controlled and guided by way of the guide elements associated with the sheet metal material of the lid.

Regarding the position of the guide element, it is to be stated that they do not or cannot lie in the free opening, they are provided outside that relatively large opening. For that purpose there is an intermediate region which is between the edge region, as described hereinbefore in the form of a folded seam edge, and the outer edge of the free opening. The at least one pin-like or post-like guide element is provided in that intermediate region. It protrudes towards one side or the other, preferably towards the interior of the container body and thus towards that side which defines the edge region of the lid in such a way that it can be connected to the body edge by being placed thereon. By virtue of the formation of the edge region it is in most cases a channel-like curvature region. The man skilled in the art can recognise from that form of the curvature region, which side of the lid is directed towards the container and which side faces outwardly.

Preferably the guide element is of a thickness which remains substantially the same. That thickness extends over the length of the guide element. A preferred height is above 5 mm. The cross-section of the at least one guide element can remain the same along that height.

The arrangement of the at least one guide element in the proximity of the edge of the opening is to be interpreted as meaning that it is adjacent to the opening. The guide element is thus markedly closer to the edge of the opening, than the connection edge region. In other words, the guide elements are displaced substantially further inwardly than outwardly, in the intermediate region. They are at the edge of the 'free opening'.

If more guide elements are fitted, for example two guide elements which are disposed in mutually opposite relationship and which extend towards the same side, it is possible to achieve a particularly accurate parallel guidance effect. The guided element, for secure re-closure, cannot then tip, but is kept substantially parallel in its position and is reliably guided in a direction perpendicularly to the plane of the central surface region, by a removal movement and a fitting movement.

A slight inclination of the guide elements is not to be excluded. That inclination is oriented closer towards 90°, that is to say above 75° and below 90°, which latter would be a parallel orientation in relation to an axis perpendicular to the central region. The at least one guide element can be made from sheet metal or plastic material.

The lid can be manufactured jointly with the guide elements. That joint manufacture in the form of a unit is preferably implemented using injection casting technology. That injection casting procedure is a representative of pressure forming with which the guide elements can be formed in position.

In order to provide for a hold to the lid surface, a continuous plastic material layer is used, which carries the one or more guide elements, or is formed in one piece with those guide elements respectively. The connection of the plastic material layer to the lid surface (the central region in the form of a panel) provides the hold for the guide elements on the metallic lid material. That hold can be implemented by a peripherally extending strip at the edge of the opening. In that respect it can be in the form of a strip at one side or two sides, in which case the arrangement can provide a U-shaped profile. Fitting the profiled layer provides for reliable positioning and orientation of the guide elements. The layer and therewith the guide elements can then no longer be separated from the lid, without involving destruction. It will be appreciated that a plastic material layer produced by injection molding or pressure shaping is formed in one piece with guide elements.

The opening is of a relatively large configuration. The embracing configuration at the edge and from the interior therefore involves a comparatively large radius, in the case of a circular hole.

The integral mounting can also be paraphrased otherwise as 'lockingly involving intimate joining of the materials concerned'.

If a number of terms are used in relation to the guide elements such as pillar, pin or post, that is intended in each case to express the fact that this at least one guide element is suitable for permitting guided displacement in the heightwise direction, which is not only a statement of use but also a way of paraphrasing the technical function involved and thus a functional definition of such structurally designed guide elements which allow such displacement in the heightwise direction, and such 'holding elements' which precisely do not allow that displacement in relation to the sheet metal of the lid.

The state of the art in contrast does not disclose any approaches in respect of the claimed invention. DE-U 202 19 794 (Blechwarenfabrik Limburg) illustrates a stackable container with an edge region 5 for sealing and permanent connection to the container body consisting of the body 2 and the bottom 4 (the references are taken from that publication). That design has a substantially planar central region (reference 3 therein) in which there is an opening delimited by an edge, for introducing or removing the filling material (the opening is identified by reference 17 therein). Arranged in the region between the edge and the opening is at least one element with which a gripping means (reference 18 therein and FIG. 3) is held to the lid surface. Those gripping elements are only visible there in FIG. 3 and are not described in greater detail, but at best the handle portion 18 is described as being present, see page 10, last paragraph thereof, and that handle portion is mounted at a considerable spacing from the opening there, in the lid surface (referred to as the upper end). The essential concept of that publication is concerned with simplified or improved labelability of the wall and for that purpose proposes restricting the variation in cross-section to a short upper region and a short lower region, and in other respects leaving the cross-section of the container the same, see therein page 8, paragraph 1. DE-U 19 34 945 is also concerned with shaped portions in the lid surface, being shown as a plan view in FIG. 2 thereof and as a sectional view in FIG. 1 thereof. They are in the form of curved or bent beads which extend around the corners substantially in the form of a circular arc and in staggered relationship. The purpose and aim is that of stiffening the lid surface. CH-C 494 165 operates with similar stiffening means. At another location, outside the lid surface, in accordance with EP-A 1 361 164 or associated WO-A 03/089 167, there is a variation in the peripherally extending damping bead (anti-peaking bead), which is varied in respect of its width or position. Once again as a departure from the anti-peaking bead, U.S. Pat. No. 2,822,952, therein column 1, lines 53 to 70, addresses improved stackability of cans, for which purpose a wave-shaped configuration for the lid surface is used, see FIG. 4 thereof. A comparable structure which however extends rather in a triangular shape in cross-section is known from U.S. Pat. No. 3,070,257, also for stacking the container or for improving stackability. GB-A 518 778 dating from the Thirties discloses a metallic container, the aim of which is to improve the ease with which the content thereof can be taken therefrom, see therein page 1, left-hand column, central paragraph; an opening, reference 4 therein, is provided, while formed around a recess in the lid surface is a channel which opens into the above-mentioned opening. A usual handle or a gripping portion is identified by reference 8 therein and is also arranged in the lid metal, see therein page 2, right-hand column, paragraph 3.

Advantageous configurations of the claimed lid and the associated processes will be apparent from the description of the examples.

BRIEF DESCRIPTION OF THE DRAWINGS

The invention is described in greater detail hereinafter by means of examples with reference to diagrammatic drawings in which:

FIG. 1 shows a view in axial section of a container, closed with a lid which is produced in accordance with an example of the invention, FIG. 2 shows a plan view on a larger scale of the lid of FIG. 1, with a free opening in the panel, FIG. 3 shows a view in cross-section of the lid of FIG. 2, FIGS. 5*a*, 5*b* and 5*c* show perspective views of three guide elements with various examples of their cross-sectional configuration.

DETAILED DESCRIPTION

Figures 4A, 4B, 5, 6:
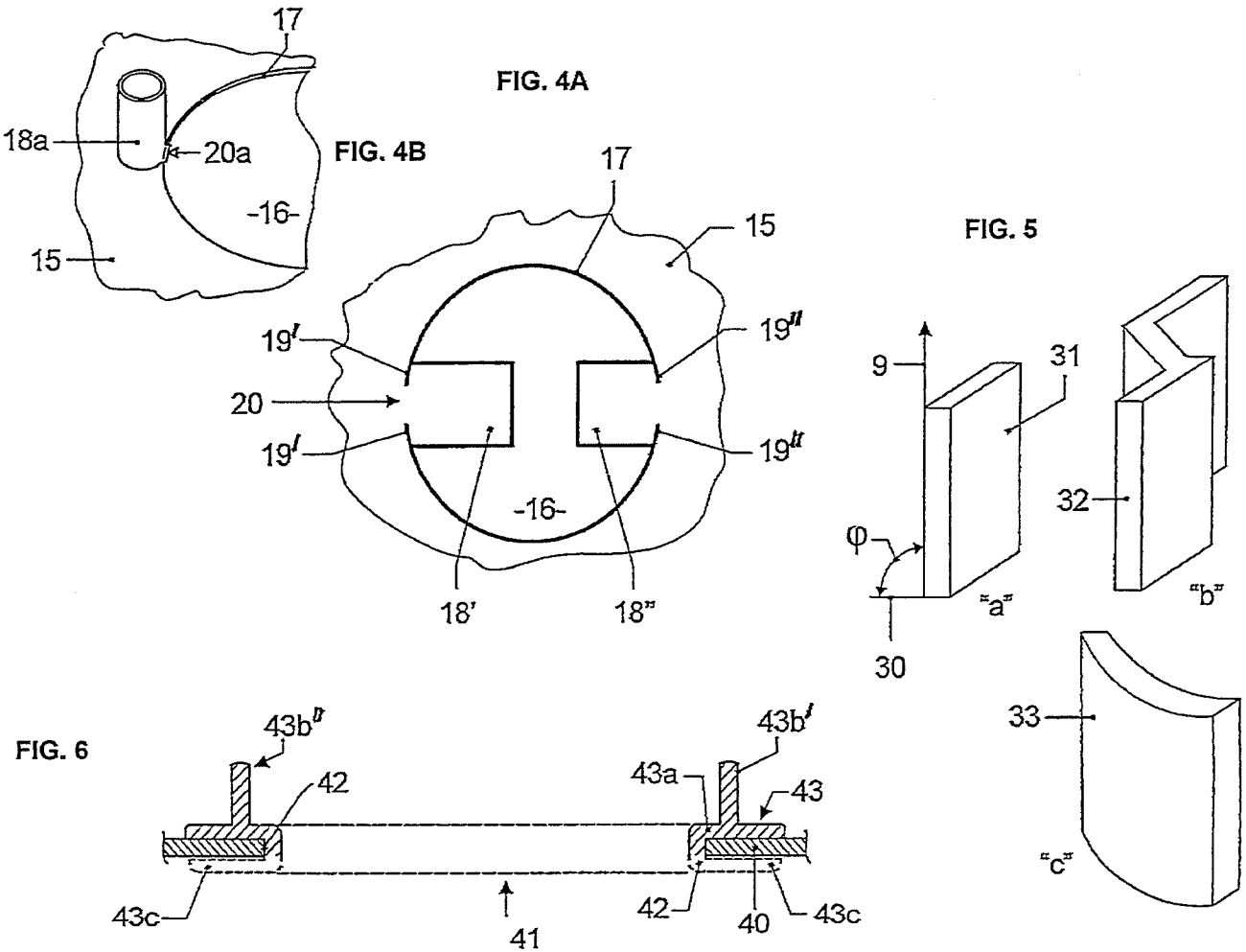
FIG. 4*a* shows a plan view of a portion of a lid surface with a filling and/or removal opening, prior to shaping of the guide elements.
FIG. 4*b* shows a perspective view of the portion of the lid of FIG. 4*a* after shaping of the guide elements.
FIG. 6 shows a cross-section of portions of further embodiments of a lid with guide elements.

FIG. 1 shows a typical container body 4 (which can be referred to just as the 'body'), as is usual for example made of sheet metal by deep drawing or stretching for beverages. It includes a cylindrical body wall 5 with a longitudinal axis 9 and a bottom 6 connected in one piece to the body wall. A lid which is manufactured or designed in accordance with a number of examples of the invention is connected to the container body 4 by a sealing permanent seam which is formed over the edge of the body and the edge of the cover 2, being in the form of a folded join 2*a*. A damping bead 2*b* (anti-peaking bead) is disposed between the folded join 2*a* and the panel 3, as a surface region.

The lid 1 has a 'lid surface' (in the form of a panel or central planar region 3) which is substantially flat and which is connected by the lid edge 2 by way of a damping or anti-peaking bead 2*b* (to the chuck wall). In the illustrated example the lid panel has three guide elements 7', 7" and 8. The two guide elements 7 extend parallel upwardly while the guide element 8 extends from the panel 3 downwardly (or inwardly of the container). All three guide elements are arranged parallel to each other and parallel to the axis 9 of the lid 1. They are in the form of pillars, posts or pins. They can extend over a length of between 5 mm and 15 mm.

One or two of those guide elements are sufficient, for example the two pins 7', 7" also being directed inwardly.

In the example shown in FIGS. 1 to 3 the cross-section of the guide elements is approximately circularly round. As shown in FIG. 5 by means of examples 31, 32 and 33 however, the cross-section may also be quite different. The shape of the cross-section depends on the purpose of use, that is to say the nature of the device which is to be guided at the guide elements, that device itself not being subject-matter of the invention.

The cross-section remains the same over the (guiding) length of the two guide elements 7', 7" or 7' and 8. The axis of each guide element is at an angle $\alpha$ of between 75°, preferably between 80° and 90°, to the plane of the lid surface, that is to say in the limit case of the angle $\phi$=90° (phi is 90°) the axis is substantially parallel to the axis 9 of the lid.

The at least one guide element can also be oriented at less than 90° with respect to the plane of the lid surface, for example between 75° and below 90°, as symbolically shown by the angle $\alpha$ in FIG. 3. The guide element 8 or also the guide element 7" is oriented at an angle of less than 90°, corresponding to that angular orientation. That applies, for a parallel orientation of the guide elements 7', 7", also for the guide element 7' which has hitherto not been mentioned. The guide elements represent respective longitudinal axes which then no longer extend parallel, with respect to the longitudinal axis 9. The longitudinal axis 9 has hitherto been referred to as the container axis, but is also a congruent longitudinal axis with respect to the lid, as shown in FIG. 2 at the centre point of the lid panel 3.

The lid shown in FIGS. 2 and 3 is produced with a filling and/or removal opening 11 which is delimited by an opening edge 10 and which is arranged eccentrically in the lid surface 3. The two outer guide elements 7', 7" are arranged near the edge opening 10 and in mutually diametrally opposite relationship. Their spacing from the opening edge 10 is advantageously from 0 to 5 mm. Nonetheless they are disposed between the opening 11 and the edge flange 2. In this case, the guide element 8 at the underside is placed in aligned relationship with the guide element 7" on the outside. The opening is relatively large. In an example which is not shown, the guide elements 7', 7" project downwardly/inwardly, 8 becomes 7" and 7' is in diametrally opposite relationship.

The guide elements can be produced or shaped in different ways in manufacture of the lid.

FIGS. 4*a* and 4*b*, by reference to the example of a lid of sheet metal, show the operation of shaping the guide elements by bending the sheet metal of the lid. For that purpose, in the illustrated example, when producing the opening 16 in the lid panel 15, the opening being defined by an opening edge 17, two mutually oppositely disposed sheet metal flaps 18', 18" are left. At the location at which they are attached to the opening edge 17, cuts are made thereinto at both sides at 19', 19", leaving a bridge region 20. The flaps are bent away at the bridge region 20 through about 90° relative to the lid surface (bend location 20*a*) and rolled in to form a respective cylinder indicated at 18*a*.

The guide elements can also be produced by deep drawing or the like directly from the lid material.

Pressure processes, for example injection die casting or moulding processes can also be used, in the context of manufacture of the lid, for producing the guide elements. Thus, when using a plastic material, the guide elements can be applied to the material of the lid surface by using pressure and increased temperature, together with a continuous plastic material layer, by 'pressure shaping' thereon. The lid and the guide elements can also be shaped as a unit from a non-metallic material.

As an example of one of those 'pressure' procedures, FIG. 6—in section and as a portion from the metallic lid panel 40—shows a continuous plastic material layer 43 which is applied along the edge 42 of the opening 41 in the panel 40 in production of the lid by pressure shaping, wherein the plastic material layer 43 in the illustrated example also at least partially embraces the opening edge 42 (at 43) and, fitted in one piece, has the at least one and preferably both guide elements 43*b'*, 43*b"*.

In addition—as shown in broken lines in FIG. 6—the opening edge can also be embraced in a U-shape in cross-section so that the layer 43, in the form of the U-shaped configuration 43*a*, 43*c*, provides that the guide posts 43*b'* and 43*b"* are permanently mounted to the edge of the opening, which cannot be separated from the lid without destruction. That manufacturing process, involving pressure and plastic material, mounts the U-shaped profile portion 43, 43*c* to the opening edge 42 and therewith provides the pillars, pins or posts 43*b'*, 43*b"* as the guide elements (for axially guided movement) on the sheet metal of the lid. The outwardly facing side 43*c* is only shown in broken line as an option in FIG. 6. The pillars/posts preferably project inwardly into the space I in the body. The shapes in FIG. 5 or the pins 7', 7" or 8 are correspondingly also arranged 'at the edge' 10 (in adjacent relationship with that edge).

The entire lid surface with the guide elements can also be formed from plastic material and can be fixedly joined by pressure shaping to a ring portion of metal, which has the lid edge, in the above-described manner.

The lid can be varied easily and with a high level of precision without involving major complication or expenditure, for any corresponding purpose of use. It is preferred for the field of closing drinks cans, which defines its panel, its size (under 60 mm in diameter) and its edge flange 2 which is suitable for the folded seam connection. Likewise the thin sheet metal thickness.

What is claimed is:

1. A method for producing a lid for a container comprising an edge region for sealing and permanent connection to a container body comprising a body wall and a bottom, the method comprising:

forming a substantially flat central panel of the lid, the central panel comprising an intermediate region and a free opening for at least one of filling and removing contents of the container, the free opening defined by an opening edge, wherein the intermediate region is positioned between the edge region of the lid and the opening edge of the free opening;

forming at least one guide element projecting from the central panel in a protruding relationship to at least one of an exterior surface and an interior surface of the central panel, the at least one guide element adapted to receive a sealing closure element, the at least one guide element positioned in the intermediate region of the central panel;

wherein in the production of the lid a plastic material layer is applied at the opening edge of the free opening with the at least one guide element shaped on the plastic material layer or shaped from the plastic material layer by a pressure shaping operation, wherein the at least one guide element is integrally formed in the shape of a pillar, pin, or post on a U-shaped profile portion of the plastic material layer, the U-shaped profile portion at least partially embracing the opening edge of the free opening from the inside, and wherein the plastic material layer is applied to at least one of the exterior surface and the interior surface of the central panel.

2. The method of claim 1, wherein the pressure shaping operation is an injection molding operation.

3. The method of claim 1, wherein the at least one guide element comprises two downwardly projecting pillar-shaped guide elements formed at the opening edge of the free opening.

4. The method of claim 1, further comprising shaping the plastic material layer with two guide elements arranged near the edge of the free opening.

5. The method of claim 1, wherein the U-shaped profile portion of the plastic material layer is for permanently mounting the at least one guide element at the opening edge of the free opening in order to prevent separation of the plastic material layer and the at least one guide element from the lid without destruction.

6. The method claim 1, further comprising integrally shaping two guide elements on the plastic material layer in mutually diametrically opposite relationship.

7. The method of claim 1, wherein the at least one guide element has a length of greater than approximately 5 mm.

8. The method of claim 7, wherein the length of the at least one guide element is between approximately 5 mm and approximately 15 mm.

9. The method of claim 7, wherein the at least one guide element has a cross-section which remains substantially constant along the length.

10. The method of claim 9, wherein a longitudinal axis of the at least one guide element is at an angle of between approximately 75° and approximately 90° with respect to a plane of the central panel.

11. The method of claim 10, wherein the angle of the longitudinal axis of the at least one guide element is between approximately 80° and approximately 90° with respect to the plane of the central panel.

12. The method of claim 5, wherein the at least one guide element is arranged between approximately 0 mm and approximately 5 mm from the opening edge of the free opening.

13. The method of claim 12, wherein the at least one guide element is arranged closer to the opening edge of the free opening than to the edge region of the lid.

14. The method of claim 12, wherein the at least one guide element comprises a first guide element, a second guide element, and a third guide element, wherein the first, second, and third guide elements are substantially parallel, wherein the first guide element and the second guide element are arranged in a diametrically opposite relationship proximate the opening edge of the free opening on a first side of the central panel, wherein the first side is one of the exterior surface or the interior surface of the central panel, wherein the third guide element is positioned on a second side of the central panel, and wherein the third guide element is collinear with the second guide element.

15. The method of claim 1, wherein the free opening is arranged eccentrically in the central panel.

16. The method of claim 6, wherein a first of the two guide elements is a first distance from the edge region of the lid, and wherein a second of the two guide elements is a second different distance from the edge region of the lid.

* * * * *